United States Patent [19]

Rattray et al.

[11] Patent Number: 4,703,224

[45] Date of Patent: Oct. 27, 1987

[54] FLUORESCENT LAMP SUBSTANTIALLY APPROXIMATING THE ULTRAVIOLET SPECTRUM OF NATURAL SUNLIGHT

[75] Inventors: Kendrick D. Rattray, Danvers, Mass.; Leo J. Plante, Seabrook, N.H.

[73] Assignee: GTE Products Corporation, Danvers, Mass.

[21] Appl. No.: 689,539

[22] Filed: Jan. 7, 1985

[51] Int. Cl.[4] ..... H01J 61/44

[52] U.S. Cl. ..... 313/487; 252/301.4 P

[58] Field of Search ..... 313/486, 487; 252/301.4 P

[56] References Cited

U.S. PATENT DOCUMENTS 2,563,901 8/1951 Nagy et al. ..... 313/486

3,670,193 6/1972 Thorington et al. ..... 313/112 X

*Primary Examiner*—David K. Moore

*Assistant Examiner*—K. Wieder

*Attorney, Agent, or Firm*—Carlo S. Bessone

[57] ABSTRACT

An improved suntanning fluorescent lamp having a spectral energy distribution of substantially UVA and UVB radiation. The spectral energy distribution substantially approximates natural sunlight below about 400 nanometers. Preferably, the lamp comprises a predetermined amount of a phosphor blend comprising cerium-activated strontium magnesium aluminate, europium-activated strontium pyrophosphate and europium-activated barium pyrophosphate.

8 Claims, 4 Drawing Figures

FLUORESCENT LAMP SUBSTANTIALLY APPROXIMATING THE ULTRAVIOLET SPECTRUM OF NATURAL SUNLIGHT

CROSS-REFERENCES TO RELATED APPLICATIONS

U.S. Ser. No. 689,548, Kendrick D. Rattray, filed concurrently herewith, "Fluorescent Lamp Substantially Approximating the Tanning Spectrum of Natural Sunlight", assigned to the Assignee of this application now abandoned.

TECHNICAL FIELD

This invention relates generally to a low pressure mercury vapor discharge lamp of the fluorescent type having a particular type phosphor coating to emit through the lamp envelope skin tanning radiation when excited by the ultraviolet radiation generated from the mercury discharge.

BACKGROUND OF THE INVENTION

Most fluorescent lamps available for inducing tanning of human skin are designed to have a spectrum of Immediate Pigment Darkening (IPD), exemplified by the DIN Direct Pigmentation Spectrum 5031 of November 1979, and therefore, emit predominantly UVA (320 nanometers of 400 nanometers) radiation. Lamps of this design generally emit a minimum of UVB (260 nanometers to 320 nanometers) which is believed to cause the formation of melanin, the skin pigment which darkens in the tanning process, but also induces erythema (i.e., skin reddening). These lamp designs only darken the melanin already present in the skin layer and generate little or no new melanin. Formation of melanin (melanogenesis) is necessary to the development of a more permanent and natural tan than that resulting from IPD, and therefore, attaining the protection of the skin from over-exposure to sunlight, which is the reason for the skin's tanning mechanism.

An example of fluorescent lamps emitting predominantly UVA and a minimum of UVB is described in UK Patent Application No. GB2059147A.

Other fluorescent lamp designs used for suntanning are predominantly UVB emitters and result in melanogenesis but are also likely to result in erythema unless exposure times are very closely controlled. Even with close control of exposure, it is likely that these lamp designs will cause damage to the upper skin layers.

Some suntanning lamps have limited amounts of the longer wavelength portion of the ultraviolet spectrum (380 to 400 nanometers) since this portion of the spectrum contributes very little to tanning. However, it is believed that this portion of the sunlight spectrum is useful to the human body and it has been shown in the past that Rhodopsin photoregeneration occurs with emissions in this range.

It is desirable then to overcome the prior art by having a suntanning lamp that produces a controlled amount of UVB for melanogenesis, an amount of UVA sufficient to induce IPD and some emission in the 380 nanometer to 400 nanometer range for other healthful effects. It would be especially desirable to have a lamp with a spectral energy distribution that substantially approximates natural sunlight in the ultraviolet region below about 400 nanometers since it would result in a tan very similar to that obtained by sunlight exposure and should also result in other health benefits due to the ultraviolet portion of sunlight.

BRIEF SUMMARY OF THE DISCLOSURE

It is therefore, an object of this invention to obviate the disadvantages of the prior art.

It is another object of the invention to provide an improved suntanning fluorescent lamp which generates both UVA and UVB radiation.

It is yet another object of the invention to provide an improved suntanning fluorescent lamp which provides a spectral energy distribution substantially approximating natural sunlight below about 400 nanometers.

These objects are accomplished, in one aspect of the invention, by the provision of a suntanning fluorescent lamp comprising a glass envelope of substantially circular configuration in cross-section and axially opposed end portions. The envelope has an impurity level within a predetermined limit and is capable of transmitting UVA and UVB radiation. An electrode is located within a respective one of the axially opposed end portions. An ionizable medium enclosed within the envelope includes an inert starting gas and a quantity of mercury. The ionizable medium when energized generates a plasma discharge comprising ultraviolet radiation and a limited proportion of visible radiation. A phosphor means is disposed on the interior surface of the envelope. The phosphor means is responsive to the ultraviolet radiation generated by the plasma discharge to provide a predetermined emission spectrum. The combined emissions of the phosphor means and the visible radiation from the plasma discharge transmitted through the envelope have a spectral energy distribution of substantially UVA and UVB radiation as compared to visible radiation. The spectral energy distribution substantially approximates natural sunlight below about 400 nanometers.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
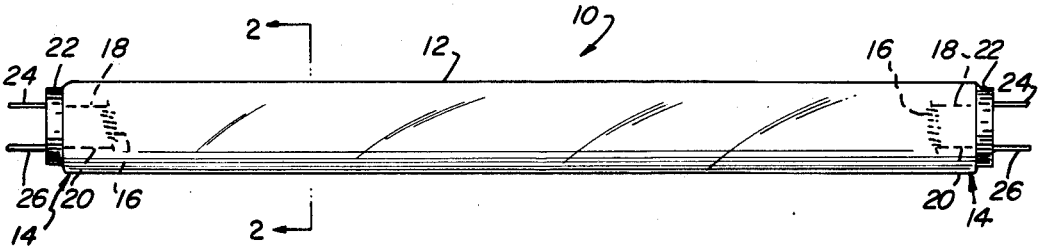
FIG. 1 is an elevational view of a fluorescent lamp in accordance with the invention.

Referring now to the drawings with greater particularity, there is shown in FIG. 1 a lamp 10 including an envelope 12 of substantially circular configuration in cross-section having axially opposed end portions. Envelope 12 which has an impurity level within a predetermined limit and is capable of transmitting UVA and UVB radiation is generally made of soda-lime or lead glass.

To produce the desired emission spectrum, envelope 12 should have a substantially low iron impurity level. Radiation within the region of 280 nanometers to 350 nanometers is absorbed by the envelope in proportion to the concentration of certain absorbing contaminants (e.g., iron oxide). Preferably, the impurity level of iron oxide in the envelope is below about 0.055%. One suitable type of glass having the proper impurity levels and having the proper transmittance characteristic is available from GTE Products Corporation of Central Falls, R.I. as SG-81 glass. The UV transmittance characteristic of this glass is shown in Table I below:

TABLE 1

| TRANSMITTED WAVELENGTH (nm) | MAXIMUM % TRANSMISSION | MINIMUM % TRANSMISSION |
|---|---|---|
| 270 | <1 | 0 |
| 280 | 3 | 1 |
| 290 | 11 | 8 |
| 300 | 31 | 27 |
| 310 | 54 | 50 |
| 320 | 75 | 67 |
| 330 | 85 | 77 |
| 340 | 90 | 82 |
| 350 | 91 | 83 |
| 360 | 91 | 85 |
| 370 | 91 | 87 |
| 380 | 91 | 89 |
| 390 | 91 | 90 |
| 400 | 91 | 91 |

Figure 2:
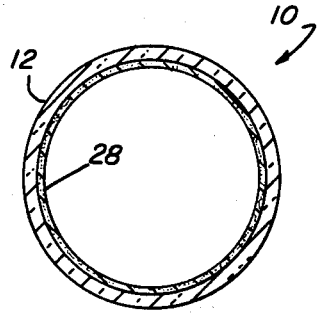
FIG. 2 is a sectional view taken along the line 2—2 of FIG. 1.

An electrode 16 is located within each of the end portions 14 of envelope 12. Each electrode 16 comprises an alkaline earth oxide coated tungsten coil supported by lead-in wires 18 and 20. Envelope 12 encloses an ionizable medium including an inert starting gas and a quantity of mercury. The starting gas may consist of argon, neon, helium, krypton or a combination thereof at a low pressure in the range of about 1 to 4 mmHg. The ionizable medium when energized generates a plasma discharge comprising ultraviolet radiation and a limited proportion of visible radiation. Suitable bases 22 are sealed to the end of envelope 12 and carry contacts 24 and 26. In the cross-section of lamp 10 shown in FIG. 2, a phosphor means 28 is disposed on the interior surface of envelope 12. Phosphor means 28 is responsive to the ultraviolet radiation generated by the plasma discharge to provide a predetermined emission spectrum. According to the invention, the combined emissions of phosphor means 28 and the visible radiation from the plasma discharge transmitted through envelope 12 has a spectral energy distribution of substantially UVA and UVB radiation as compared to visible radiation. The spectral energy distribution substantially approximates natural sunlight below about 400 nanometers.

In a preferred embodiment of the fluorescent lamp of this invention, the intensity value of the spectral energy distribution at about 320 nanometers is within the range of from about 20% to 40% of the intensity value at about 400 nanometers. Preferably, the intensity value of the spectral energy distribution at about 350 nanometers is within the range of from about 45% to 75% of the intensity value at about 400 nanometers. Also, an intensity value of the spectral energy distribution is about 380 nanometers which is within the range of from about 70% to 90% of the intensity value at about 400 nanometers is preferred.

Phosphor means 28 may comprise, for example, a predetermined amount of a phosphor blend comprising predetermined proportions of at least the following phosphors:

cerium-activated strontium magnesium aluminate
europium-activated strontium pyrophosphate, and
europium-activated barium pyrophosphate.

Preferably, the weight percentages of the total blend are substantially as expressed in the following:

cerium-activated strontium magnesium aluminate 42.5 to 47.5%
europium-activated strontium pyrophosphate 28.0 to 32.0%
europium-activated barium pyrophosphate. 24.0 to 26.0%

Phosphors usually respond most efficiently to ultraviolet radiation at a wavelength of 253.7 nanometers since this is the primary wavelength generated by the plasma discharge. The highest efficiency is obtained when the mercury vapor within the lamp is at a pressure of about 0.008 millimeter of mercury. Besides the primary wavelength, the plasma discharge generates wavelengths of 297 nanometers, 313 nanometers and 365 nanometers. The amount of 297 and 313 nanometer radiation transmitted through the envelope can be influenced by the amount of phosphor disposed on the interior surface of the envelope. It is desirable to have the predetermined amount of the phosphor blend sufficient to substantially suppress the intensity value of the spectral energy distribution at about 297 nanometers and 313 nanometers so that excessive levels do not result. The best results were obtained when the predetermined amount of the phosphor blend coated on the interior surface of the envelope was approximately 3.8 milligrams per centimeter$^2$.

Figure 3:
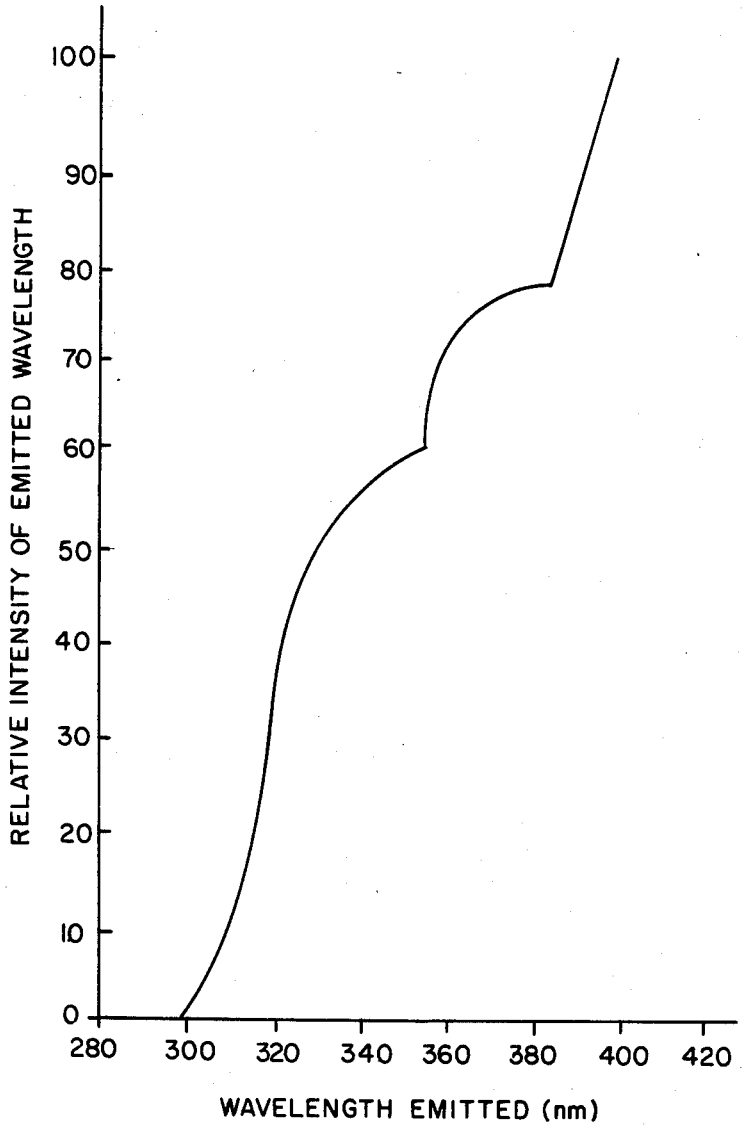
FIG. 3 is a graph depicting the spectral energy distribution below 400 nanometers of natural sunlight.

In a lamp made in accordance with the invention, the spectral energy distribution substantially approximates natural sunlight below about 400 nanometers. FIG. 3 is a spectral energy distribution of natural sunlight below 400 nanometers as depicted in "Ultraviolet Radiation", L. R. Koller, pg. 133. As shown in FIG. 3, the intensity value at 320 nanometers, 350 nanometers and 380 nanometers relative to about 400 nanometers is approximately 30%, 59% and 78% respectively.

Figure 4:
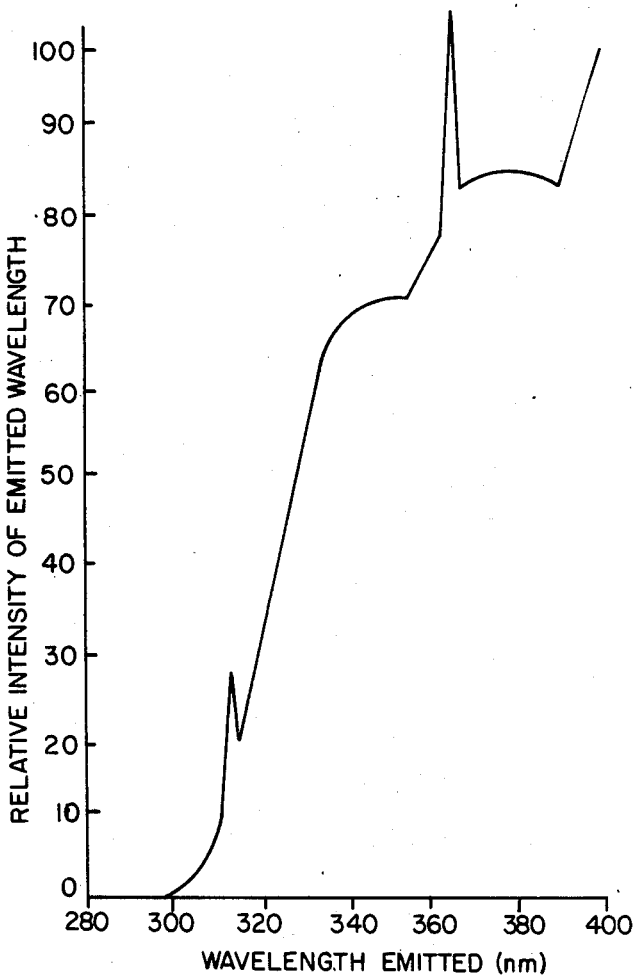
FIG. 4 is a graph depicting the spectral energy distribution below 400 nanometers of a lamp made in accordance with the present invention.

With reference to FIG. 4 there is shown a graph depicting the spectral energy distribution below 400 nanometers of an example of a fluorescent lamp of the present invention with a phosphor means comprising a phosphor blend of approximately 45% by weight cerium-activated strontium magnesium aluminate, 30% by weight europium-activated strontium pyrophosphate and 25% by weight europium-activated barium pyrophosphate. As shown in FIG. 4, the lamp has a spectral energy distribution of substantially UVA and UVB radiation. The spectral energy distribution substantially approximates natural sunlight below about 400 nanometers as shown in FIG. 3.

While there have been shown what are at present considered to be the preferred embodiments of the invention, it will be apparent to those skilled in the art that various changes and modifications can be made herein without departing from the scope of the invention as defined by the appended claims.

We claim:

1. A suntanning fluorescent lamp comprising:

a glass envelope having a substantially circular configuration in cross-section and having axially opposed end portions, said envelope having an impurity level within a predetermined limit and being capable of transmitting UVA and UVB radiation;

first and second electrodes, each of said electrodes located within a respective one of said axially opposed end portions;

an ionizable medium enclosed within said envelope including an inert starting gas and a quantity of mercury which when energized generates a plasma discharge comprising ultraviolet radiation and a limited proportion of visible radiation; and a phosphor means disposed on the interior surface of said envelope, said phosphor means being responsive to said ultraviolet radiation generated by said plasma discharge to provide a predetermined emission spectrum, and the combined emissions of said phosphor means and said visible radiation from said plasma discharge transmitted through said envelope having a spectral energy distribution of substantially UVA and UVB radiation as compared to visible radiation, said spectral energy distribution substantially approximating natural sunlight below about 400 nanometers, the intensity value of said spectral energy distribution at about 320 nanometers being within the range of from about 20% to 40% of the intensity value at about 400 nanometers.

2. The lamp of claim 1 wherein the intensity value of said spectral energy distribution at about 350 nanometers is within the range of from about 45% to 75% of the intensity value at about 400 nanometers.

3. The lamp of claim 2 wherein the intensity value of said spectral energy distribution is about 380 nanometers is within the range of from about 70% to 90% of the intensity value at about 400 nanometers.

4. The lamp of claim 1 wherein said phosphor means comprises a predetermined amount of a phosphor blend comprising predetermined proportions of at least the following phosphors:

cerium—activated strontium magnesium aluminate,
europium—activated strontium pyrophosphate, and
europium—activated barium pyrophosphate.

5. The lamp of claim 4 wherein said phosphor means comprises a predetermined amount of a phosphor blend comprising at least the following phosphors at substantially the weight percentages of the total blend as expressed in the following:

cerium—activated strontium magnesium aluminate 42.5 to 47.5%
europium—activated strontium pyrophosphate 28.0 to 32.0%
europium—activated barium pyrophosphate 24.0 to 26.0%.

6. The lamp of claim 4 wherein said predetermined amount of said phosphor blend is sufficient to substantially suppress the intensity value of said spectral energy distribution at about 297 nanometers and about 213 nanometers.

7. The lamp of claim 4 wherein said predetermined amount of said phosphor blend is approximately 3.8 milligrams per centimeter$^2$.

8. The lamp of claim 1 wherein the impurity level of iron oxide is below about 0.055%.

* * * * *